United States Patent [19]

Domkowski

[11] 4,267,962

[45] May 19, 1981

[54] SECURITY SYSTEM

[75] Inventor: Ronald A. Domkowski, Arlington Heights, Ill.

[73] Assignee: Honor-Gard System, Chicago, Ill.

[21] Appl. No.: 53,427

[22] Filed: Jun. 29, 1979

[51] Int. Cl.[3] ..... G07F 9/06

[52] U.S. Cl. ..... 232/15; 232/43.2

[58] Field of Search ..... 232/15, 16, 31, 32, 232/43.2

[56] References Cited

U.S. PATENT DOCUMENTS

| | | | |
|---|---|---|---|
| 1,983,089 | 12/1934 | Knee | 232/15 |
| 2,009,085 | 7/1935 | Jackson | 232/15 |
| 2,783,937 | 3/1957 | Hudson | 232/15 |
| 3,033,442 | 5/1962 | Erlichman | 232/15 |
| 3,677,461 | 7/1972 | Nitschneider | 232/15 |
| 3,807,627 | 4/1974 | Nitschneider | 232/15 |
| 3,837,566 | 9/1974 | McGough | 232/15 |

*Primary Examiner*—Roy D. Frazier
*Assistant Examiner*—Peter A. Aschenbrenner
*Attorney, Agent, or Firm*—Hume, Clement, Brinks, Willian & Olds, Ltd.

[57] ABSTRACT

A security system for mounting a coin-collecting container in an operating position on a housing provided in a coin-processing machine. The system may incorporate integral locking means which can be positioned at a plurality of locking stations on the machine housing, to thereby adapt the system for a variety of non-processing machines. In one embodiment, the system is adapted to freely receive a coin of maximum size in the opened position and to lock against the discharge of a coin of minimum size in a locked position. Means are also provided to improve security by using high-strength materials at critical shear points, and by using spring-biasing forces to positively lock the system components in a secure position.

12 Claims, 18 Drawing Figures

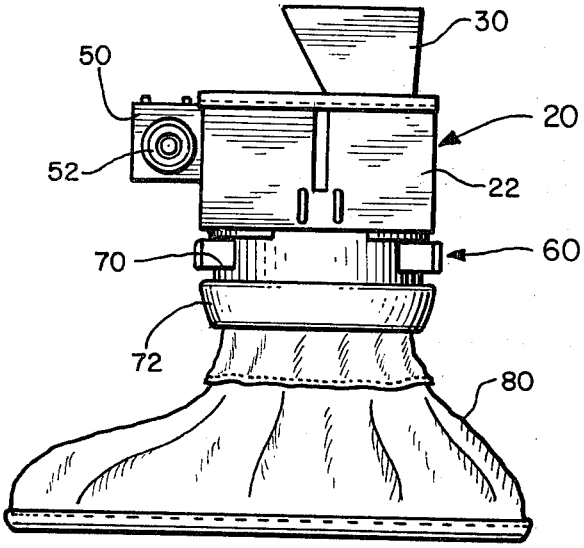
FIG. 1
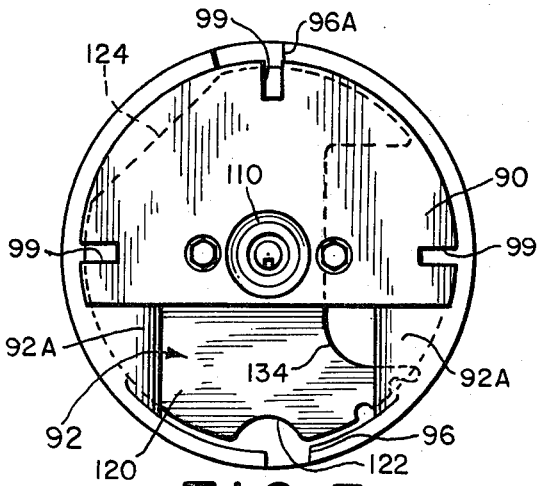
FIG. 3
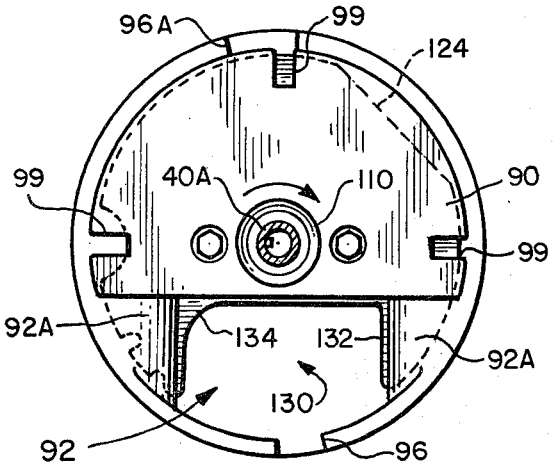
FIG. 3a
FIG. 2
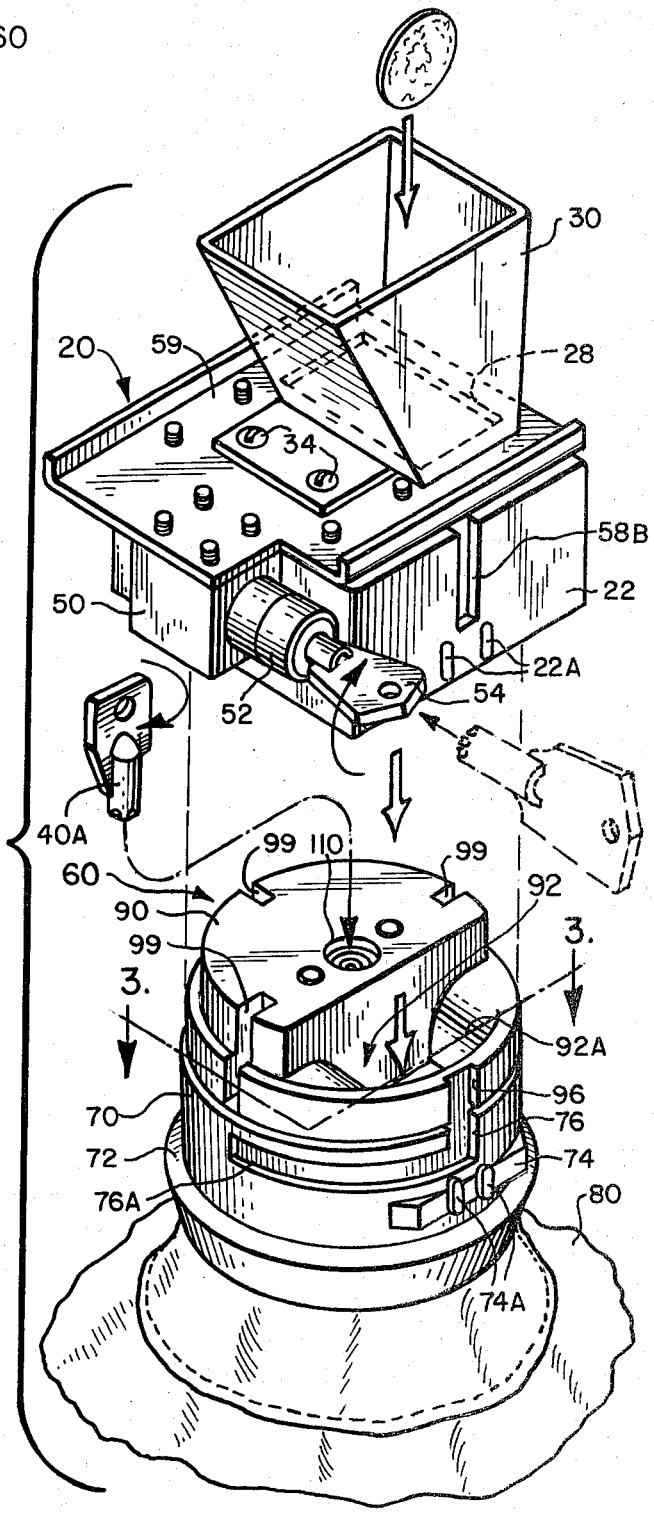

FIG. 12
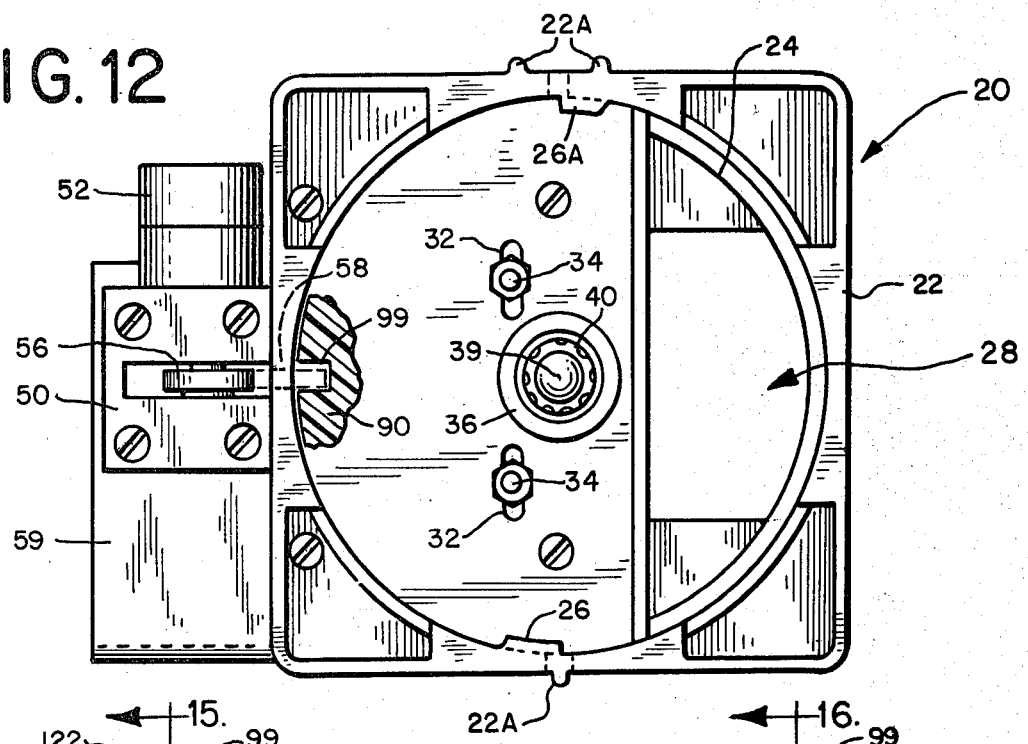
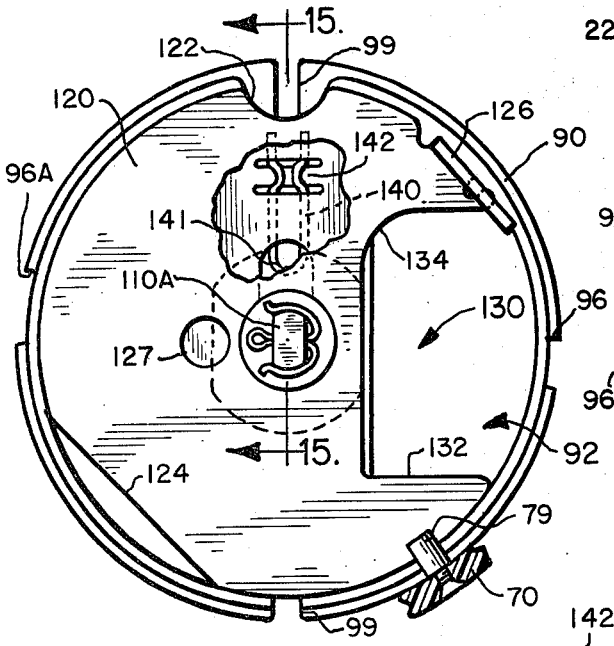
FIG. 13
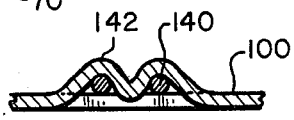
FIG. 15a
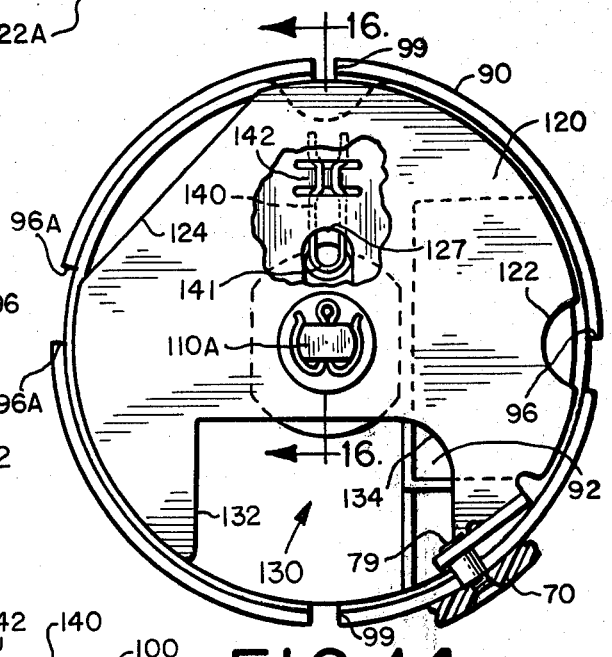
FIG. 14
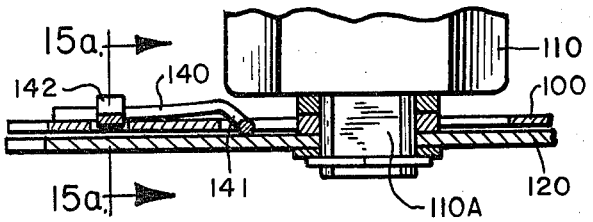
FIG. 15
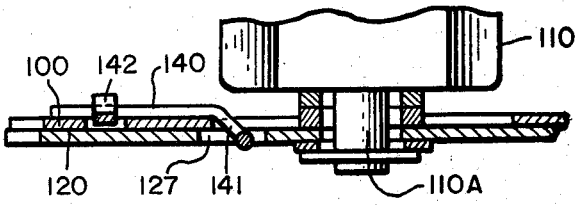
FIG. 16

SECURITY SYSTEM

BACKGROUND AND SUMMARY OF THE INVENTION

This invention relates in general to an improved security system for handling money, and more particularly relates to an improved system for collecting and storing money in coil-operated vending machines.

A security system for use in coin-operated vending machines is fully described in U.S. Pat. No. 3,807,627, which issued Apr. 30, 1974 for "Simplified Security Device" and which is assigned by mesne assignments to the same assignee as the present invention. As explained generally in that patent, in coin-operated vending machines, coins are deposited and a merchandise selection is made. The coins pass through a series of operating stations in the machine which accumulate and totalize the money, and which register a credit for the particular item of merchandise selected. Then, after the merchandise is dispensed, or simultaneously with the dispensing of the merchandise, the coils are passed to a storage and collection receptacle, such as a coin box or coin bag.

Typically, a coin operated vending machine is serviced by one or more route men, who periodically visit the machine to replenish the supply of merchandise, and to collect the money which is stored in the coin box or coin bag. In some installations, different personnel service the merchandise supply and collect the money in the coin bags.

Several problems have developed in the industry concerning the design and operation of coin-operated vending machines. Consumer demand for coin vending machines and products has been high, while consumer tolerance to machine failures has been generally low. Thus, the structure and operation of vending machines should be simple and reliable, to minimize the problems created by the machines for the consumer. In addition, the advent of the new U.S. dollar coin, and the increased use of vending machines in other countries, have created design and operating problems of adopting vending machines for receiving coins of a variety of sizes, particularly coins of larger sizes. Hence, an immediate need in the U.S. market is to design and develop equipment for the vending machines which readily adopt the machines to coins varying in size from dimes to U.S. dollars, without jamming. The machines also must be capable of accepting a larger volume of coins, due to the increase in prices of the products being vended by the machines. Such adaption to different coinage and different coin volume necessarily must be accomplished without a loss of reliabity, and preferably with inexpensive, lightweight and durable materials.

There has also been a need in the industry for a more versatile or universal apparatus for collecting and storing coins in the vending machines. Vending machines of different makes, sizes, use and styles have different internal structure. This variation in structure results in different locations for the operating components, such as route key locks and the like. Time and expense would be saved, and efficiency improved, with a versatile coin storage and collection system which can be readily adapted to fit a variety of vending machines designs.

Another serious problem in the industry has been the theft and pilferage of money by route men and other persons having knowledge of or access to the interior of the vending machines. Any design which meets the foregoing problems with respect to versatility, increase coin variety and volume, and the need for reliable jamproof operation, must also be concerned with improving the securing from theft or pilferage.

Accordingly, the present invention provides a security system which is adaptable for use with coin-operated vending machines for collecting and storing the coins which meets the above-noted problems and design requirements. The device in accordance with this invention will freely accept a large volume of coins of various sizes, including the smaller dimes and the larger U.S. dollar coins. This versatility is accomplished in a manner which still provides a reliable, relatively jam-free system, while utilizing relatively inexpensive and lightweight materials. Moreover, the device in accordance with this invention has improved versatility and is readily adapted to fit a variety of vending machine installations without substantial modification. The above design and operating requirements are also met while providing the device with enhanced security to prevent pilferage or theft of the coins during the vending, storing or collecting operations.

DESCRIPTION OF A PREFERRED EMBODIMENT

Further objects and features of the present invention will become more apparent from the following description of a preferred embodiment thereof, as shown in the accompanying drawings, in which:

FIG. 1 is a side elevational view of the improved security system of the present invention for collecting and storing coins in a vending machine or the like;

FIG. 2 is an exploded perspective view of the improved security system, showing the interrelationship between the upper housing, which is usually joined to a vending machine, and the locking and mounting components of a coin collecting bag;

FIG. 3 is a plan view of a portion of the components of the coin collecting bag, taken along the line 3—3 in FIG. 2, illustrating the bag locked in a closed condition;

FIG. 3A is a plan view of a portion of the components of the bag similar to FIG. 3, showing the components arranged with the gate in an opened condition, which allows access to the interior of the bag;

FIG. 12 is a bottom plan view of the upper housing assembly, taken along the line 12—12 in FIG. 9;

FIG. 13 is a bottom plan view of the locking cap, as shown in FIGS. 2 and 3, illustrating the locking plate in an opened position;

FIG. 14 is a bottom plan view of the locking cap, as shown in FIG. 13, illustrating the locking plate after rotation into a closed position;

FIG. 15 is a partial cross-sectional view of the locking cap, taken along the line 15—15 in FIG. 13, showing the structure and operation of a spring for assisting in the movement of the locking plate into a closed position;

FIG. 15A is a cross-sectional view taken along the line 15*a*—15*a* in FIG. 15, showing the means for mounting the locking plate spring; and FIG. 16 is a partial cross-sectional view of the locking cap, taken along the line 16—16 in FIG. 14, showing the spring in position to positively lock the locking plate into a closed position.

Figure 4:
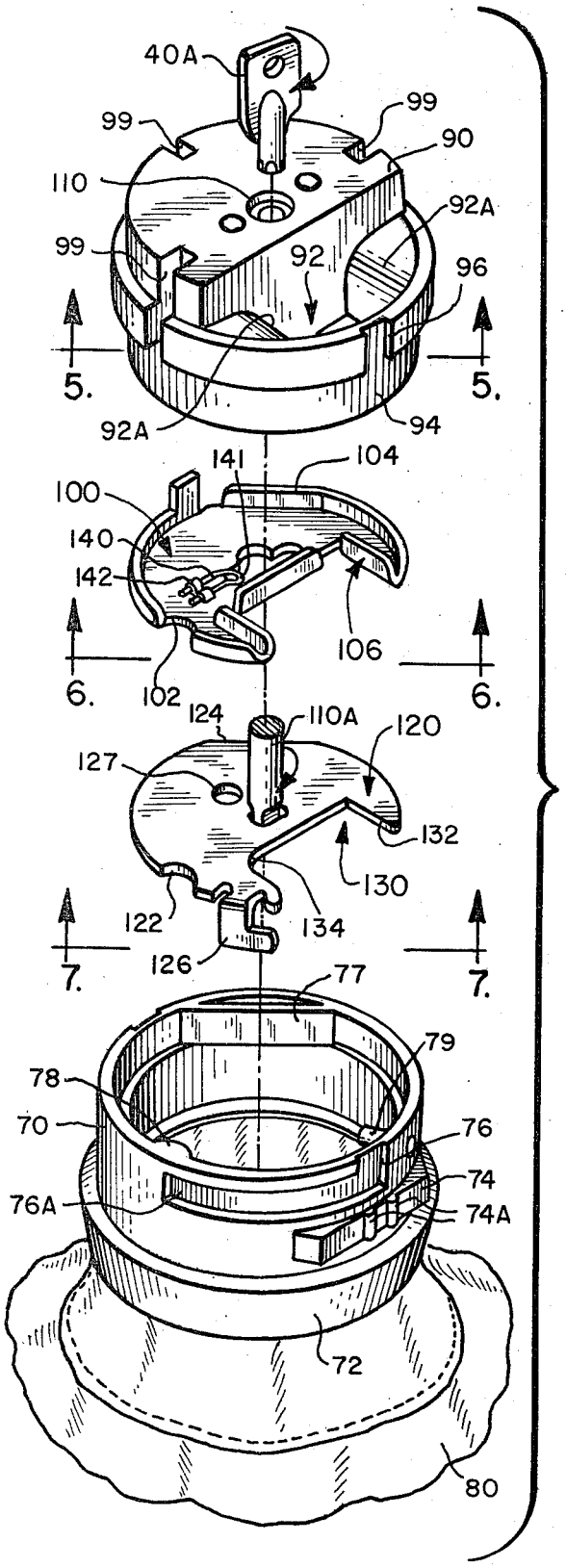
FIG. 4 is an exploded perspective view illustrating the locking and mounting components of the coin bag which cooperate to allow the bag to be selectively locked in an opened or a closed condition.

As seen generally in the drawings, the improved security system in accordance with this invention generally includes an upper housing assembly 20. The housing assembly 20 is adapted to be secured within a vending machine, and is designed to receive the various coins which are inserted into the machine during the vending operation. A second major component of the present system is a portable coin collection device, such as the coin bag 80. The coin bag 80 is made from a heavy canvas material or the like, and is adapted to collect and store coins which are inserted into the vending machine and transmitted to the housing assembly 20. A third major component of the present system is a coin bag locking and mounting assembly 60. This bag assembly 60 is joined to the upper mouth portion of the coin bag 80, and functions to selectively connect the coin bag 80 to the upper housing assembly 20 in the vending machine.

More specifically, the upper housing assembly 20 and the coin bag assembly 60 cooperate to lock the coin bag 80 in place on the housing assembly 20, in an opened position, for receiving coins during the operation of the vending machine. Secondly, these components function to automatically lock the coin bag 80 in a closed position when the coin bag 80 is removed from the housing assembly 20 during the coin collecting and accounting process. FIG. 1 illustrates these above-described major components 20, 60 and 80 in their assembled position, as they would appear within a vending machine during the vending phase operation. FIG. 2 generally illustrates the relationship of the components as the coin bag 80 is removed from the housing assembly 20 in a locked position.

Figure 8:
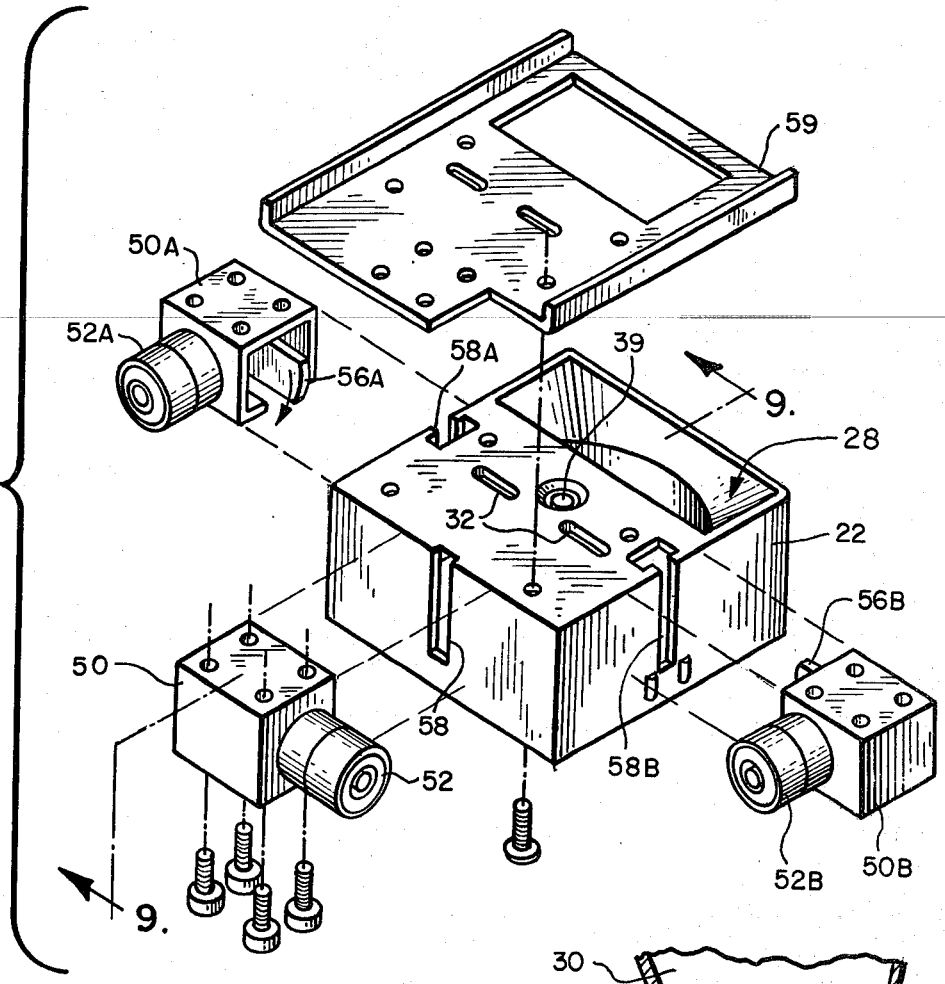
FIG. 8 is an exploded perspective view of the upper housing assembly of the system in accordance with this invention, which is usually fixed within a vending machine, illustrating the manner of adopting the system to different lock positions in various vending machines.

The upper machine housing assembly 20 is more fully illustrated in FIGS. 2, 8 and 12 of the drawings. Referring to those figures, the housing assembly 20 includes a central, generally rectangular housing member 22. To minimize weight and expense, the housing member 22 is preferably cast from a lightweight, impact-resistant plastic material. The lower portion of member 22 is provided with a circular opening 24 of preselected dimensions, for receiving the coin bag mounting and locking assembly 60, as described further below. Diametrically opposed positioning and retaining tabs 26 and 26A are cast into the member 22, for cooperation with mating grooves and slots in the coin bag mounting and locking assembly 60.

As seen clearly in FIGS. 2 and 8, one side of the upper portion of the member 22 is provided with a coin-receiving opening 28. The opening 28 extends across the member 22, and has a width sufficient to receive the largest anticipated coin, e.g., the U.S. ½dollar coin, without jamming. A funnel 30 is mounted on the member 22 above the opening 28, to direct the coins from the vending machine through the coin-receiving opening 28. A pair of lateral slots 32 provided in the member 22 receive fasteners 34 to join the funnel 30 to the housing. The slots 32 permit adjustment of the funnel 30 to the varying dimensions of different vending machines.

Figure 9:
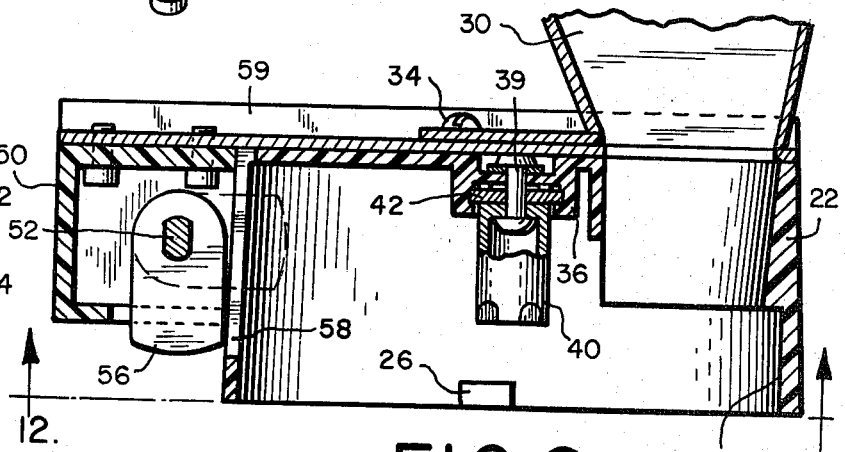
FIG. 9 is a cross-sectional view of the upper housing assembly taken along the line 9—9 of FIG. 8.
Figure 10:
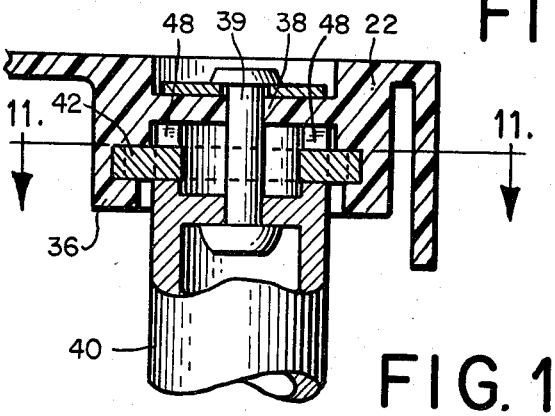
FIG. 10 is an enlarged partial cross-sectional view of the key stem portion of the upper housing as shown in FIG. 9.

As shown in FIGS. 9, 10 and 12, the central portion of the housing member 22 includes a downwardly extending boss 36. A central opening 38 in the boss 36 receives a rivet 39 for securing within the boss a key stem 40. As explained further below, the key stem 40 functions as a key, and is inserted in a mating locking member provided on the coin bag locking and housing assembly 60, for activating the mechanisms which open and close the bag 80 during the vending and coin collecting operation.

Due to the security requirements of the system, this key stem 40 must be firmly retained against rotation within the housing member 22 during the insertion and removal of the coin bag 80. Otherwise, the bag 80 could be removed from the member 22 in an opened position, and the coins in the bag could be removed. Security requirements also dictate that this key stem 40 be secured firmly in the boss 36, to prevent pilferage by tampering with the machine to override the security locking functions of the system.

Figure 11:
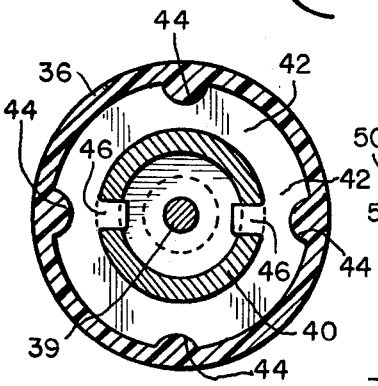
FIG. 11 is a cross-sectional view taken along the line 11—11 in FIG. 10, of the means for fixing the key stem in the housing to improve the resistance of the device to tampering.

Accordingly, the key stem 40 is firmly implanted in the boss 36 against rotation by means of a high-strength retaining washer 42. As shown in FIG. 11, the retaining washer 42 includes peripheral recesses 44 at the quadrants of the washer, and a pair of diametrically opposed abutment tabs 46. The washer 42 is cast in-place in the boss 36 as the housing member 22 is formed. By this arrangement, the material forming the housing 36 firmly engages the washer 42 within the peripheral recesses 44, as seen in FIG. 11. This method of construction firmly imbeds the washer 42 in the boss 36, and causes the recesses 44 to function as detents which prevent rotation of the washer. As shown in FIGS. 10 and 11, the washer abutment tabs 46 are dimensioned for engagement with the key stem 40 within correspondingly dimensioned and diametrically opposed grooves 48. To decrease the possibility of tampering and pilferage, the key stem 40 and the retaining washer 42 are made from a high-strength material, such as heat-treated steel. By this arrangement, any attempts to rotate the key stem 40 in the boss 36 are prevented by the sheer strength of the abutment tabs 46.

As set forth above, the housing assembly 20 is designed to be mounted in place in the vending machine during the operation of the system of this invention. The design of such vending machines is not standardized, so that different machines require different locations for the assembly 20 and different operating key placements. Accordingly, to adjust the housing assembly 20 to different vending machine designs, the housing 20 in accordance with this invention is readily adaptable for mounting within a vending machine in a plurality of different positions.

As illustrated in FIGS. 2, 8 and 12, this versatility of the housing assembly 20 is made possible by the inclusion in the system of a separate, integrally-designed lock box 50. This lock box 50 carries a tumbler-type key lock 52 of suitable construction which is preferably operated by a cylindrical key 54. The lock 52 is either a counter-clockwise or clockwise lock, depending on the orientation of the lock box 50. The lock 52 illustrated in FIG. 2 is a clockwise lock, and is is activated into a locked position by rotating the key 54 90° in a counter-clockwise direction.

The lock 52 includes a locking tab 56 which is moved between a locked and an unlocked position by the rotation of the key 54. In the lock box 50 illustrated in FIGS. 2 and 8, the lock 52 is arranged so that the tab 56 is in a downward unlocked position, as shown in solid lines in FIG. 9, when the key 54 is inserted therein. A rotation of the key 54 counter-clockwise through a 90° arc moves the tab 56 into its inward locked position, as shown in dotted lines in FIG. 9. A mating slot 58 is provided in the adjacent side wall of the housing member 22, as shown in FIGS. 8 and 9. The slot 58 receives the locking tab 56, and permits the tab 56 to extend into the housing 22 in a locking position when the key lock 52 is rotated into its locked position, as described above. A mounting plate 59 is secured to the upper surface of the housing member 22, and is adapted to mount the key box 50 on the housing member 22 in the desired location adjacent the slot 58.

The illustrated mounting plate 59 and the slot 58 will also receive a key box 50 and lock 52 in a second orientation. This second orientation is accomplished by reversing the key box 50, so that the lock 52 extends from the opposite side of the box 50 (downwardly from the box 50 in FIG. 12). The tab 56 can be rotated into a locking position within the related slot 58 by reversing the operation of the lock 52. With such a modification, a 90° rotation of the lock 52 in a clockwise direction moves the tab 56 into the slot 58.

As shown in FIG. 8, the housing assembly 20 is designed for two additional mounting positions for the key box 50. A second side wall of the housing 22 is provided with a locking slot 58A for receiving the locking tab 56A, of a lock box 50A having a key lock 52A. The mounting plate 59 would be replaced by a different plate which would extend over the key box 50A. As described above with respect to te box 50, the key box 50A can be used for two different key locations, by reversing the position and rotational characteristics of the key lock 52A. Likewise, a third wall of the housing member 22 is provided with a locking slot 58C. A third modified mounting plate 59 is used to mount a lock box 50B adjacent the locking slot 58B. The related key lock 52B is operable to rotate the tab 56B of the lock into a locking position within the slot 58B, in a manner similar to that described above. The key box 50B also can be used in two locations by reversing the position and rotational characteristics of the key lock 52B. In this manner, the housing assembly 20 is adapted to receive three key boxes 50, 50A or 50B, each of which can be used in two locations. This design greatly improves the versatility of the system by permitting the assembly 20 to be readily adapted to a plurality of vending machine designs.

As indicated in FIGS. 2 and 4, other major components of the security system of this invention are the collection and storage bag 80 and the associated locking and mounting assembly 60. The assembly 60 includes a bag mounting ring 70 as shown in FIGS. 2 and 4. This ring 70 is preferably cast from a durable lightweight plastic material, such as the same material from which the housing assembly 20 is cast. The ring 70 is permanently secured to the mouth of the bag 80 by a retaining ring 72 The ring 72 is made from a high strength material, such as steel or the like, and slidably engages within a circular groove provided on the bag ring 70. Thus, the ring 70 is firmly attached to the bag 80, but can rotate with respect to the bag. The outer surface of the ring 72 includes diametrically spaced ledges 74 which assist in the proper alignment of the ring 70 and the bag 80 with the housing assembly 20 during the mounting of the bag within the vending machine. The ledges 74 are provided with indicia tabs 74, which correspond to similar tabs 22A on the housing 22 (see FIG. 2) to further facilitate the proper initial alignment of the bag ring 70 and the housing 22. The bag ring 70 also includes a pair of diametrically opposed thread-type grooves 76 having a horizontal portion 76A. During the mounting operation, the grooves 76 are aligned with the tabs 26, 26A (see FIGS. 9 and 12) on the housing member 22. Relative rotation of the bag ring 70 will slide the tabs 26, 26A within the grooves 76, 76A, and secure the bag ring 70 and the associated bag 80 onto the housing member 22. The opposed tabs 26, 26A and the mating grooves 76A are preferably of slightly different dimensions, so that proper orientation of the bag ring 70 with respect to the housing 20 is assured.

The interior surface of the bag ring 70 includes means which assist in the alignment of the various components, and in the locking of the bag 80 selectively in an opened or closed position during the vending and collection operations. In this regard, the interior surface of the ring 70 includes an abutment sector 77; a shoulder 78; and a projecting retaining pin 79. These parts 77, 78 and 79 are located approximately 120° apart, to provide a stable three-point connection to the locking plate 120 of the locking cap 90, as explained further below. The configuration of the parts 77, 78 and 79 also cooperate to properly align the locking cap 90 and the bag ring 70.

Figure 5:
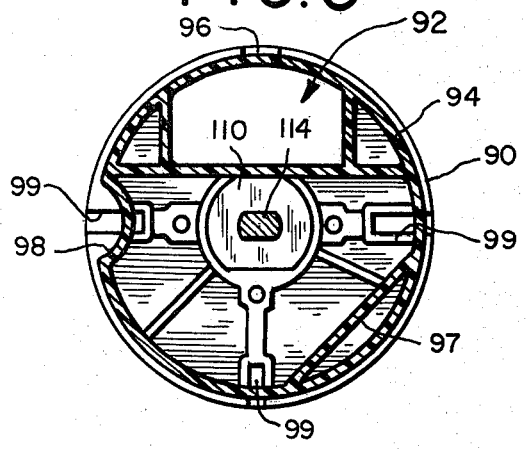
FIG. 5 is a cross sectional view, taken along the line 5—5 in FIG. 4, illustrating the structure of the bottom of the locking cap for the coin bag.

As also seen in FIGS. 2 and 4, the assembly 60 further includes a locking cap 90. The cap 90 is preferably made from the same lightweight, durable material as used to form the bag ring 70 and the housing member 22. The cap 90 is dimensioned to fit within the wide mouth of the bag ring 70, to selectively close the bag 80 during the use of the system of the present invention. As seen in FIGS. 4 and 5, a large sector of the cylindrical cap 90 defines a coin-receiving opening 92. This opening 92 is aligned with the opening 28 in the machine housing 22, to receive coins from the machine and direct the coins into the bag 80. The direction of the coin flow is indicated by the arrows in FIG. 2. The side walls 92A of the opening 92 are preferably contoured as shown in FIGS. 2 and 4, to assure a smooth entry of all sizes of coins into the bag 80. As discussed above, the opening 92 is dimensioned so that it will freely receive the largest potential coin, such as the U.S. ½ dollar coin.

A distending circular flange portion 94 on the lower part of the cap 90 is dimensioned to extend within the bag ring 70. This flange portion 94 includes a straight recess 97 and a circular recess 98, as seen in FIGS. 4 and 5. These recesses 97 and 98 align, respectively, with the shoulders or abutments 77 and 78 provided on the interior surface of the bag ring 70, as seen in FIG. 4. The recesses 97 and 98 thus align the cap 90 and the ring 70 properly, and prevent the cap 90 from rotating with respect to the ring 70. Diametrically opposed vertical grooves 96 are also provided on the upper portion of the cap 90. As seen in FIG. 2, these grooves 96 align with the corresponding grooves 76 in the bag ring 70. The grooves 96 and 97 are, hence, adapted to receive the tabs 26, 26A on the housing 22 as the bag 80 and the mounting and locking assembly 60 are inserted upwardly within the housing assembly 20.

Figure 6:
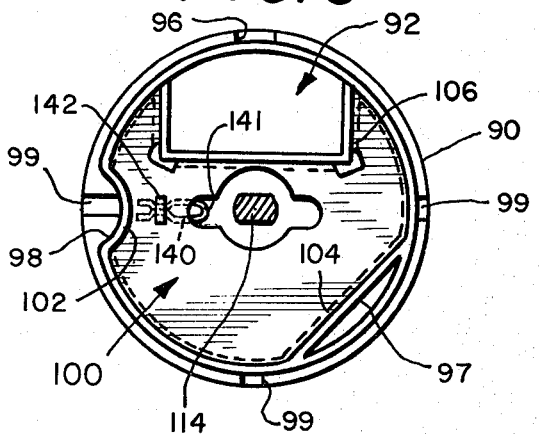
FIG. 6 is a cross-sectional view of the locking cap taken along line 6—6 in FIG. 5, showing the use of a closure plate in accordance with this invention, to minimize jamming of the coins in the locking cap.

As further seen in FIGS. 4–6, the cap 90 also includes three locking grooves 99, which are spaced 90° apart on the quadrants of the cap 90. As explained further below, these locking grooves 99 become aligned with the slots 58 provided in the housing member 22, and are thereby positioned to receive the tab 56 of the lock 52. When the system in accordance with this invention is assembled and locked in position, the lock 52 and the tab 56 will prevent the rotation of the cap 90 within the housing 22 due to the engagement between the cap grooves 99 and the tab 56.

As seen in FIG. 5, the casting of the cap 90 from the preferred material normally creates a series of webs and compartments in the underside of the cap 90. It has been found that if these webs and compartments remain exposed, it is possible for a coin to become entrapped or jammed within the underside of the cap 90. When this event occurs, the entrapped coin will interfere with the locking operation of the system. Accordingly, the cap 90 is provided with a closure plate 100, as seen in FIG. 4, to prevent such interference with the functions of the system.

FIG. 6 illustrates the placement of the closure plate 100 on the under side of the cast cap 90. As seen in FIG. 6, the closure plate 100 includes recesses 102 and 104 which align with the recesses 98 and 97, respectively, provided on the cap 90. An opening 106 is also provided in the closure plate 100, for alignment with the coin-receiving opening 92 of the cap 90. Thus, the closure plate 100 can be placed on the underside of the cap 90 to prevent the jamming of coins into the cap, without interfering with the functions of the cap 90.

The center of the cap 90 includes a cylindrical lock 110. This lock 110 receives the key stem 40 of the housing assembly 20 when the cap 90 is inserted within the housing member 22. The lock 110 also can be actuated by a separate key 40A (FIG. 4) which corresponds to the key stem 40. This separate key 40A is usually retained at the home office of the vending company so that the bags 80 cannot be opened outside of the home office. A key shaft 110A extends downwardly from the lock 110, as seen in FIG. 4, and is secured to a rotatable locking plate 120. The connection between the shaft 110A and the plate 120 is a positive connection, so that the plate 120 rotates in unison with the key shaft 110A upon activation of the lock 110.

Figure 7:
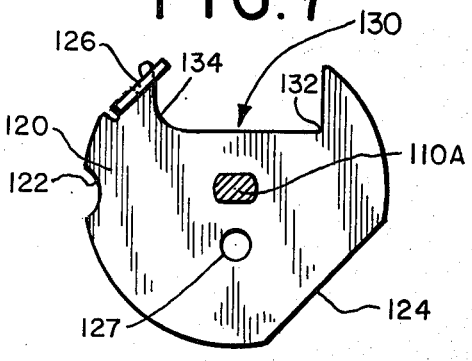
FIG. 7 is a bottom view of the rotatable locking plate used in this invention, as viewed along the line 7—7 in FIG. 4.

As shown in FIGS. 4 and 7, the plate 120 is provided with recesses 122 and 124 which coincide with the recesses 98 and 97 on the cap 90. As clearly seen in FIG. 4, the plate 120 also includes a distending locking leg 126. This leg 126 is designed to engage with and lock against the pin 79 when the cap 90 is placed within the bag ring 70 and the plate 120 rotated a selected distance (preferably 90°) into a locked position by the operation of the lock 110. The locking leg 126 cooperates with the pin 79 to operate as a detent against further rotation of the plate 120, and to lock the plate 120 and the cap 90 onto the bag ring 70.

The locking plate 120 includes a coin-receiving aperture 130. In accordance with this invention, this aperture 130 is specially constructed so that in an open position, in alignment with the opening 92 provided in the cap 90, the aperture 130 freely receives the largest expected coin in any configuration or orientation (see FIG. 13). For example, the width of the aperture 130 could be selected to receive a U.S. dollar coin which has a diameter of approximately one inch. Furthermore, the plate 120 is designed so that, when rotated 90° with respect to the cap 90, it will effectively close the coin-receiving aperture 92 of the cap 90 (see FIG. 14). In this closed position, the plate 120 must block the passage from the bag 80 of a coin of the smallest expected dimensions, such as U.S. dime having a diameter of approximately 0.70 inches.

Thus, the configuration of the coin-receiving aperture 130 must accept a coin of maximum size in one position (open; FIG. 13) block the passage of a coin of minimum size in another position (locked closed; FIG. 14). To accomplish these functions, the aperture 130 has a width, and includes a leading edge 132 which has a length, greater than the size of the largest coin, e.g., greater than one inch. The trailing edge 134 of the aperture 130 (the edge which trails into the opening 92 of the cap 90 as the locking plate 120 is rotated) has a length corresponding to the length of the edge 132. Thus, the width of the aperture 130 throughout its length (to the edge connecting the edges 132 and 134) is equal and the aperture is substantially rectangular. However, the trailing edge 134 is provided with a substantial radius of curvature which reduces the effective length of the edge 134. The radius of curvature of edge 134 also reduces the effective area of the trailing half of the aperture 130 below the area of the leading half. This arrangement of the plate 120 and the coin-receiving aperture 130 permits the plate 120 to be moved between an open position, such as shown in FIGS. 3A and 13, and a locked position, as shown in FIGS. 3 and 14. In the opened position, the area of plate aperture 130 is generally coincident with the area of the cap opening 92, and the coin-receiving aperture 130 will freely receive the largest coin in any orientation. In the closed position, as seen in FIGS. 3A and 14, the radius of curvature provided on the trailing edge 134 is selected to sufficiently reduce the width and area of the trailing half of the aperture 130 so that the plate 120 blocks the aperture 130 for the smallest coin. For example, if a U.S. dime is the smallest coin, the radius for the edge 134 is selected so that, as seen in FIG. 14, the opening between the plate 120 and the cap 90 in the cap opening 92, has a maximum dimension less than about 0.70 inches. Of course, different parameters would be needed for handling coinage of different sizes.

As seen in FIGS. 13–16, the cap 90 also includes a locking spring 140, to assist in positively locking the plate 120 in the locked position. The locking spring 140 is a U-shaped spring wire unit which is secured to the closure spring 140 extends downwardly through an opening in the plate 100, towards the locking plate 120. The spring 140 thus biases the locking plate 120 away from the closing plate 100 and thereby minimizes sliding friction between the two adjacent plates. As seen in FIGS. 15 and 16, the locking plate 120 is provided with an aperture 127 for receiving the projecting end 141 of the spring 140, as the plate 120 approaches the final, locked position. The curvature of the spring end 141 cooperates with the aperture 127 to urge the plate 120 into its final locked position. The spring 140 thus overcomes any frictional drag between the adjacent plates 100 and 120, and assures that the plate 120 will be positively locked by the lock 110. The spring 140 thereby minimizes the possibility of frictional drag preventing the complete enlargement of the tumblers in the lock 110. Under such circumstances, the locking of the plate 120 would be incomplete and the security of the system compromised.

The operation of the system in accordance with this invention usually commences with the bag 80 and the locking and mounting assembly 60 in a locked position. As shown in FIGS. 2 and 3, in this locked position the aperture 92 in the cap 90 is closed by the plate 120, so that even the smallest coin cannot be removed from the bag 80. In this locked position, the cap 90 is oriented with respect to the bag ring 70, so that the grooves 96 and 76 are in alignment, as shown clearly in FIG. 2. A route man carries the bag in this condition to a vending machine, for placement within the housing assembly 20 in the vending machine.

To install the bag 80 in the machine, the route man orients the cap 90 and the bag 80 beneath the housing assembly 20, so that the grooves 96 and 76 are in alignment with the tabs 26, 26A within the housing 22 (see FIG. 2). The cap 90 and bag 80 are then directed upwardly into the recess 24 (FIG. 9) defined by the housing 22. The tabs 26, 26A slide within the grooves 96 and 76, and the key stem 40 is inserted within the key lock 110 in the cap 90. When the insertion is complete, the route man then rotates the bag ring 70 and the associated cap 90 (counter-clockwise in FIG. 2) through a 90° arc. This rotation causes the tabs 26, 26A to engage within the horizontal portion 76A of the grooves. The tabs 26, 26A and grooves 76A thus retain the bag 80 and cap 90 within the housing 22.

Thus, rotation of the bag 80 and cap 90 through a 90° arc also causes the key stem 40 to activate the lock 110 and rotates the locking plate 120 a corresponding distance into an opened position, such as shown in FIGS. 3A and 13. In this position, the bag 70 and cap 90 are affixed within the housing member 22, and the system is prepared to receive, collect and store the coins fed into the vending machine. To lock the bag 80 in place, the route man used a key 54, as illustrated in FIG. 2. This key 54 is inserted into the lock 52 and turned through a 90° arc, as described above, to activate the lock 52. The locking tab 56 is thereby projected through the slot 58 in the housing member 22 and into the groove 99 provided on the cap 90. The key 54 then can be removed. The engagement between the cap grooves 99 and the locking tab 56 prevents the rotation of the cap 90 in the machine. Likewise, since the cap 90 mates the abutments 77, and 78 on the bag ring 70, the bag ring 70 is likewise precluded from rotation. Accordingly, the bag 80 is locked in place, and cannot be removed from the vending machine 20.

In the next phase of operation, the route man returns to the vending machine to collect the coins when the bag 80 is filled. To accomplish this, the route man key 54 is inserted in lock 52 and rotated 90° in the opposite direction (clockwise in FIG. 2). This removes the locking tab 56 from the slot 99 in the cap 90. The bag ring 70 and the associated cap 90 then can be rotated by the route man through a 90° arc. This rotation again aligns the housing tabs 26, 26A with the grooves 96 and 76 (FIG. 2) so that the bag 80 can be removed from the housing mechanism 22. This rotation also causes the key stem 40 to activate the key lock 110, to rotate the lock 110, and the associated plate 120 into a closed position, as shown in FIGS. 3 and 14. In this position, the locking tab 126 engages the pin 79, and the plate 120 closes the cap closure 92. The cap 90 is thus secured to the bag ring 70 in a locked and closed position before the bag 80 can be removed from the vending machine housing 20.

The route man then removes the bag 70 from the housing 20, in a locked condition and delivers it to a central clearing house, such as the home office. At the home office a key 40A, comparable to the key insert 40, is inserted within the lock 110, and the plate 120 is rotated into the opened position, as shown in FIGS. 3A and 13. The cap 90 then can be removed from the bag ring 70, and the coins can be discharged. When the accounting department is finished with the bag 80, the cap is again placed on the bag; the lock 110 activated to close the locking plate 110 across the aperture 92; and the process described above can be repeated by installing the bag 80 in a vending machine.

Although the invention has been described above with a certain degree of particularly, it should be understood that this disclosure has been made only by way of example. Consequently, numerous changes in the details of construction and in the combination and arrangement of the components, as well as in the possible modes of utilization in accordance with this invention will be apparent to those familiar with the art, and may be resorted to without departing from the scope of the invention.

What is claimed is:

1. A security system for mounting a coin-collecting container in a plurality of operating positions on a coin-processing machine, said system comprising:

a mounting member removably attached to said container including a coin-receiving aperture for directing coins into said container;

rotatable closure means movable on said member between an opened position allowing coins to pass through said aperture and a closed position blocking the passage of coins through said aperture;

first actuating means on said member for selectively driving said closure means between said opened and closed positions;

abutment means arranged in a plurality of selected positions on said member;

a housing adapted for connection to said coin-processing machine and further adapted to releasably connect said mounting member and the associated container to said machine, said housing including means for receiving coins processed by said machine and directing the coins into said container;

a plurality of locking stations defined by said housing and arranged in selected positions about the housing, each station being alignable with at least one of said abutment means with said member connected to said housing;

second actuating means on said housing and engagable with said first actuating means to drive said closure means into said opened position as said member is rotated with respect to said housing to align one of said abutment means with one of said locking stations; and integral locking means adapted to be positioned at one of said locking stations and including a locking detent movable between a locked and an unlocked position, said locking means and detent being arranged to permit relative rotation of said member and said housing in said unlocked position and further arranged to engage said locking detent with said abutment means on said member, to thereby prevent the relative rotation of said member and said housing, with said detent in said locked position.

2. A security system in accordance with claim 1 wherein said locking means comprises an integral lock box adapted for mounting on said housing at any of said locking stations and a rotatable lock connected to said detent.

3. A security system in accordance with claim 2 wherein said detent comprises a movable arm projecting from said lock box and each locking station includes an opening for receiving said arm so that said arm engages said abutment means in said locked position.

4. A security system in accordance with claim 3 wherein said abutment means comprises a plurality of recesses spaced in selected positions on said member and dimensioned to receive said locking arm.

5. A security system in accordance with claim 3 wherein said abutment recesses are equally spaced on said member by a selected degree and said locking stations are equally spaced on said housing by substantially the same selected degree.

6. A security system in accordance with claim 2 wherein said lock box and lock are adopted to be positioned in a plurality of positions at each locking station, whereby the system is readily adaptable to a variety of coin-processing machine.

7. A security system in accordance with claim 1 wherein said first actuating means on said member comprises a second lock means and said second actuating means on said housing comprises a key stem engagable with said second lock means to move said closure means and further wherein said key stem is firmly mounted on said housing against rotation by high-strength mounting means.

8. A security system in accordance with claim 7 wherein said high-strength mounting means comprises an insert firmly joined to said housing and formed from a material having a substantially higher shear strength than said housing with said insert defining a portion having high shear resistance in engagement with and preventing the rotation of said key stem.

9. In a security system for use with a coin-collecting container and a coin-processing machine, the improvement comprising:

a mounting and locking member removably attached to said container and including a coin-receiving opening for directing coins of varying size into said container, the minimum dimension of said opening being selected to exceed the maximum dimension of said coins;

a rotatable locking plate mounted on said member and movable between an opened position and a closed position, said plate including an aperture rotatable into alignment with said opening with said plate in said opened position and configured to substantially coincide with said opening, to thereby allow the passage of coins of a selected maximum dimension through said opening and plate aperture in said opened position; and said plate further being configured so that the area of the trailing half of said aperture, as said plate is rotated into said closed position, is a selected amount less than the area of the leading half of said aperture, and said plate thereby blocks the passage of a coin of a selected minimum dimension through said opening in said member.

10. The security system in accordance with claim 9 wherein said opening in said member is a substantially rectangular opening having a selected area and further wherein said plate aperture is a subtantially coincidental rectangle having at least a leading edge, a trailing edge and a connecting side, said trailing edge and connecting side defining a selected radius of curvature which thereby selectively reduces the area of the trailing half of said aperture.

11. In a security system for use with a coin-collecting container and a coin-processing machine, the improvement comprising:

a mounting and locking member removably attached to said container and including a coin-receiving opening for directing coins into said container;

a rotatable locking plate mounted on said member and movable between an opened position and a closed position, said plate including an aperture alignable with said opening, with said plate in said opened position, to allow coins to pass through the aligned opening and aperture into said container, said plate in said closed position operating to block said passage of coins through said opening;

locking means to releasably secure said plate in said closed position; and a closure plate mounted on the lower side of said member above said closure plate and having an aperture coincident with the coin-receiving opening in said member, so that said closure plate allows the passage of coins through said opening while preventing jamming of coins between said member and said rotatable locking plate.

12. The security system in accordance with claim 11 further including spring means mounted on said closure plate and is arranged to bias said closure and locking plate apart and to engage and drive said locking plate toward said closed position.

* * * * *

UNITED STATES PATENT AND TRADEMARK OFFICE

CERTIFICATE OF CORRECTION

PATENT NO. : 4,267,962

DATED : May 19, 1981

INVENTOR(S) : Ronald A. Domkowski

It is certified that error appears in the above—identified patent and that said Letters Patent is hereby corrected as shown below:

In the left column of the title page, line 6, delete "Honor-Gard System" and insert --Honor Gard, Inc.--.

In the specification, at column 1, line 9, delete "coil" and insert --coin--; at line 52, delete "reliabity" and insert --reliability--; at line 63, delete "machines" and insert --machine--.

At column 5, line 47, delete "te" and insert --the--.

At column 6, line 6, after the first "72", insert --.--.

At column 7, line 32, delete "under side" and insert --underside--.

At column 8, line 57, delete "extends" and insert --extending--.

UNITED STATES PATENT AND TRADEMARK OFFICE

CERTIFICATE OF CORRECTION

PATENT NO. : 4,267,962

DATED : May 19, 1981

INVENTOR(S) : Ronald A. Domkowski

It is certified that error appears in the above—identified patent and that said Letters Patent is hereby corrected as shown below:

At column 9, line 58, delete "man and insert --man's--.

At column 10, line 20, delete "particularly" and insert --particularity--.

At Claim 6, line 5, delete "machine" and insert --machines--.

Signed and Sealed this

*Nineteenth* Day of *January 1982*

[SEAL]

*Attest:*

GERALD J. MOSSINGHOFF

*Attesting Officer*

*Commissioner of Patents and Trademarks*